US009009908B2

(12) United States Patent
Screen et al.

(10) Patent No.: US 9,009,908 B2
(45) **Date of Patent: *Apr. 21, 2015**

(54) LOTION APPLICATOR AND METHOD THEREFOR

(71) Applicants: David Screen, Las Vegas, NV (US); Kimberly Screen, Las Vegas, NV (US)

(72) Inventors: David Screen, Las Vegas, NV (US); Kimberly Screen, Las Vegas, NV (US)

( * ) Notice: Subject to any disclaimer, the term of this patent is extended or adjusted under 35 U.S.C. 154(b) by 127 days.

This patent is subject to a terminal disclaimer.

(21) Appl. No.: 13/791,094

(22) Filed: Mar. 8, 2013

(65) Prior Publication Data

US 2014/0250620 A1 Sep. 11, 2014

(51) Int. Cl.

| | |
|---|---|
| ***A45D 34/04*** | (2006.01) |
| ***A45D 40/28*** | (2006.01) |
| *A61M 35/00* | (2006.01) |
| *A47K 7/02* | (2006.01) |

(52) U.S. Cl.

CPC ..... *A45D 34/04* (2013.01); *A61M 35/00* (2013.01); *A47K 7/02* (2013.01); *A45D 40/28* (2013.01); *A45D 2200/1081* (2013.01)

(58) Field of Classification Search

CPC .... A61M 35/00; A47K 7/02; A41D 19/01594
USPC ..... 15/222, 244.1, 208
See application file for complete search history.

(56) References Cited

U.S. PATENT DOCUMENTS

| | | | | |
|---|---|---|---|---|
| 8,430,854 | B2 * | 4/2013 | Screen et al. | 604/310 |
| 2008/0289080 | A1 * | 11/2008 | Szucs | 2/161.1 |

* cited by examiner

*Primary Examiner* — Shay Karls
(74) *Attorney, Agent, or Firm* — Weiss & Moy, P.C.; Jeffrey D. Moy

(57) ABSTRACT

A device for applying lotion to a user's body has a foam layer. A cover layer is applied to a top surface of the foam layer. A pair of openings formed through the foam layer and the cover layer. A reinforcement layer is applied around each opening. A tab member is formed along an outer perimeter of the strip member.

18 Claims, 4 Drawing Sheets

LOTION APPLICATOR AND METHOD THEREFOR

BACKGROUND

Embodiments of this disclosure relate generally to lotion applicators and, more particularly, to a lotion application that may be used to apply lotion to a user's back.

Presently, there are many different types of devices which may enable a person to apply a cleaner, such as soap, or a lotion to an area of the body. More specifically, most of these types of devices may be used to apply the soap and or lotion to areas of the person's body that may be difficult to access with one's hands or a hand-held wash cloth.

One type of applicator is a handle and brush/sponge combination. The problem with this type of device is that the brush/sponge area is relatively small. Thus, it may be difficult to ensure that all areas of the user's back have been reached. Further, these types of devices have handles which are of fixed length. This can lead to difficulty in efficiently using a fixed length applicator by persons of different size who must grasp the ends of the applicator and try to manipulate it behind their back.

Other types of applicator devices may be characterized as having an elongated flexible strip of fabric material where soap and or lotion may be applied. Hand grippable handles, frequently formed by fabric loops or the like, enable the user to grasp opposite ends of the applicator and extend it across his/her back in a manipulating movement. Unfortunately, if the strip of fabric is too flexible, the soap/lotion may not be properly applied as the soap/lotion may not be evenly applied. Similarly, if the strip of fabric is too stiff, the soap/lotion will not be properly applied as areas of the user's back may not be reached since the strip of fabric may not be able to bend to reach all areas of the user's back.

Therefore, it would be desirable to provide a system and method that overcomes the above.

SUMMARY

A device for applying lotion to a user's body has a foam layer. A cover layer is applied to a top surface of the foam layer. A pair of openings formed through the foam layer and the cover layer. A reinforcement layer is applied around each opening. A tab member is formed along an outer perimeter of the strip member.

A device for applying lotion to a user's body has a strip member. The strip member comprises a foam layer and a cover layer applied to a top surface of the foam layer. An opening is formed through each end of the strip member through the foam layer and the cover layer. A reinforcement layer is applied to a top surface of the cover layer around each opening and to a bottom surface of the foam layer around each opening. A tab member is formed along an outer perimeter of the strip member.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
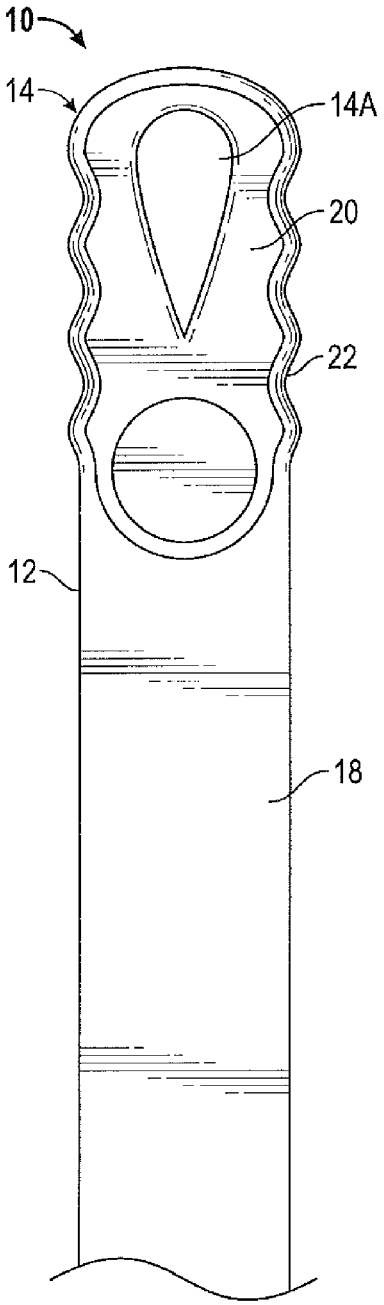
FIG. 1 is a magnified view of the handle area of the applicator of the present invention.
Figure 2:
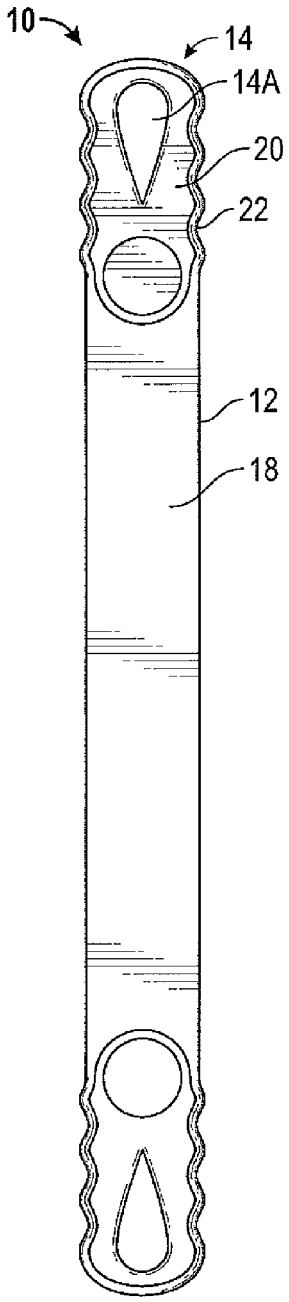
FIG. 2 is a top view of the applicator of the present invention.
Figure 3:
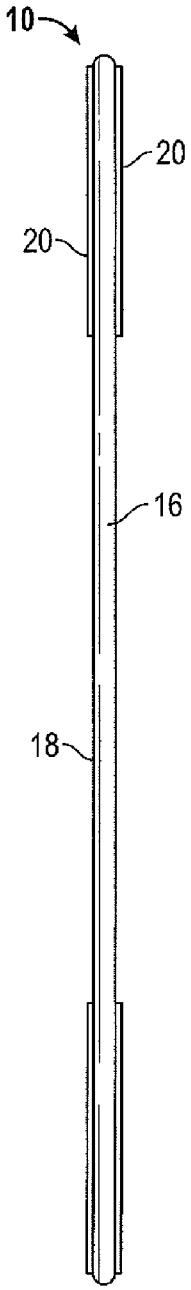
FIG. 3 is a side view of the applicator of the present invention.
Figure 4:
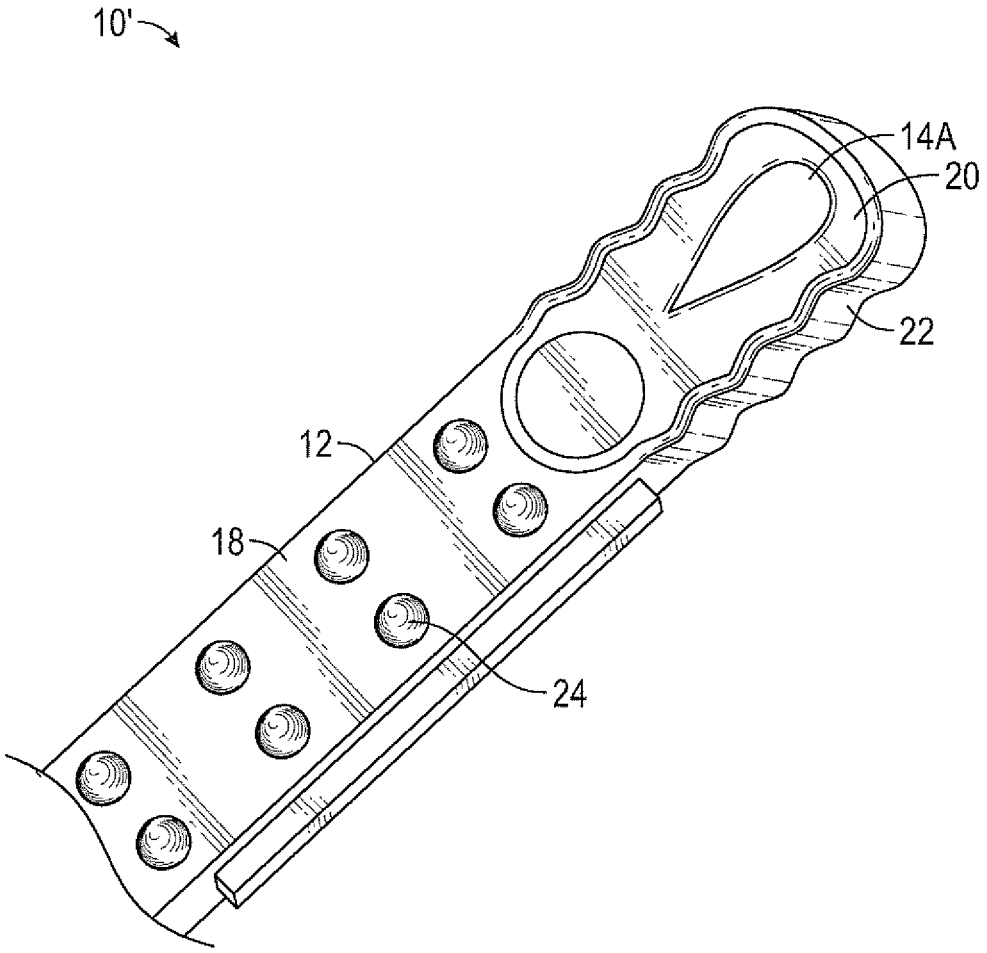
FIG. 4 is a magnified perspective view of another embodiment of the applicator of the present invention.
Figure 5:
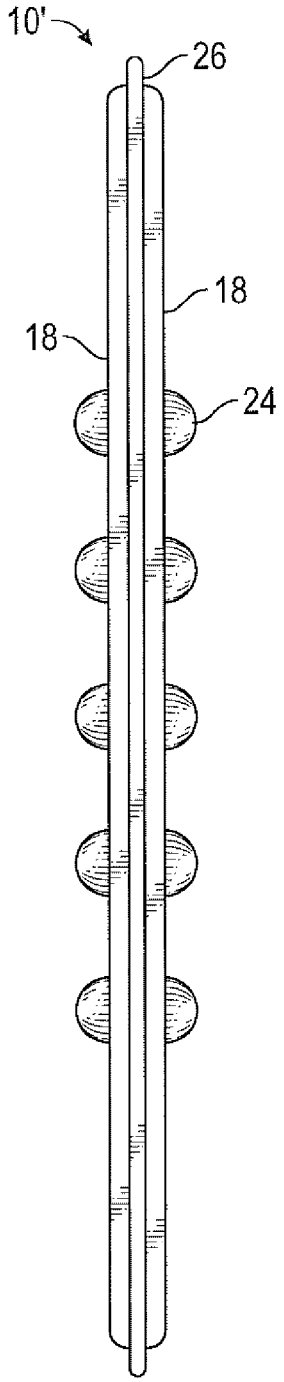
FIG. 5 is a side view of the applicator shown in FIG. 4.
Figure 6:
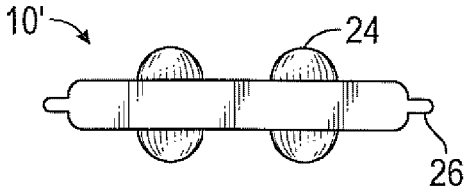
FIG. 6 is a front view of the applicator shown in FIG. 4.
Figure 7:
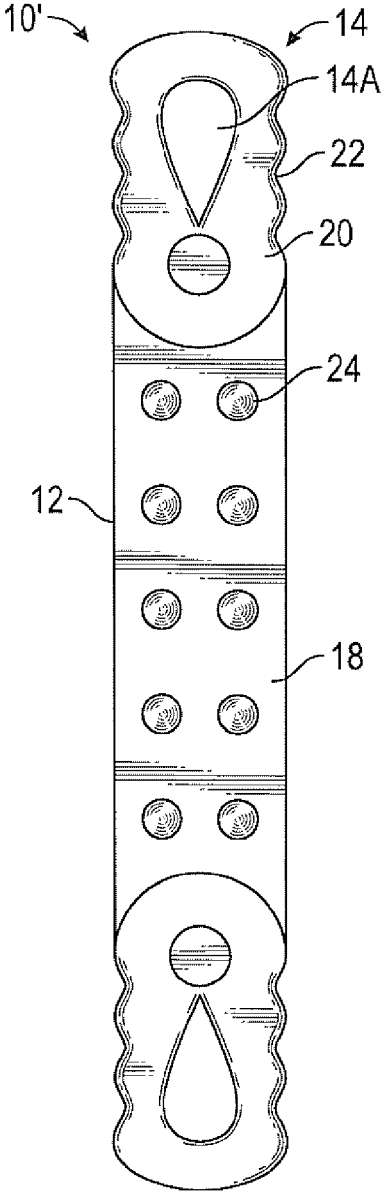
FIG. 7 is a top view of the applicator shown in FIG. 4.
Figure 8:
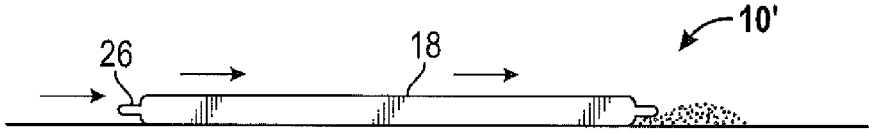
FIG. 8 is a side vide of the applicator shown in FIG. 4 used to collect excess lotion.
Figure 9:
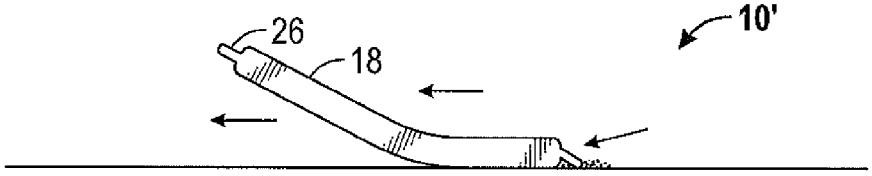
FIG. 9 is a side vide of the applicator shown in FIG. 4 used to spread excess lotion.
Figure 10A:
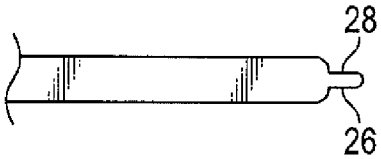
FIG. 10A-10K are side views of other embodiments of the tab member.
Figure 10B:
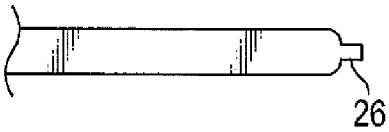
Figure 10C:
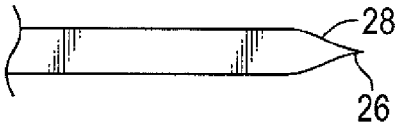
Figure 10D:
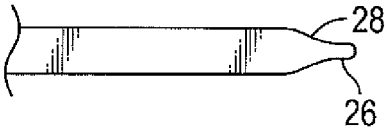
Figure 10E:
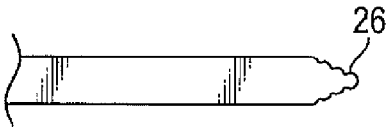
Figure 10F:
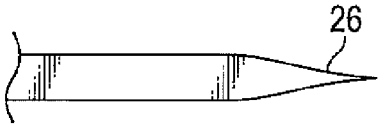
Figure 10G:
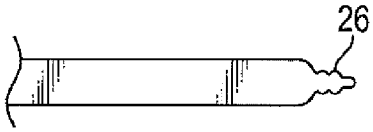
Figure 10H:
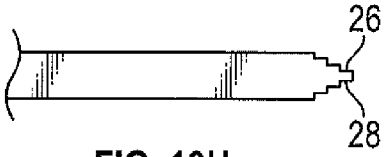
Figure 10I:
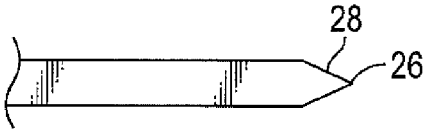
Figure 10J:
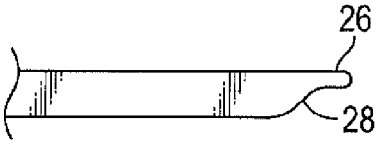
Figure 10K:
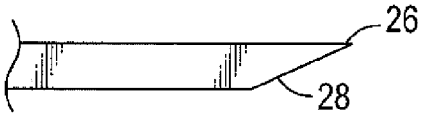

Referring to FIGS. 1-3, an applicator 10 is shown. The applicator 10 may be used to apply soap, lotion or the like (hereinafter lotion) to areas of a user's body which may be hard to reach. In accordance with one embodiment, the applicator 10 may be used to apply lotion to the back of a user.

The applicator 10 may be comprised of body member 12. The body member 12 may have handle members 14 formed on each end of the body member 12. The body member 12 is formed of a material that is flexible to evenly apply the lotion to the user, but stiff enough to evenly apply the lotion.

In accordance with one embodiment, the body member 12 may be formed of a foam layer 16. The foam layer 16 may allow the body member 12 to be flexible so that the body member 12 conforms to the shape of the user. This may allow the applicator 10 to more easily reach all areas of the user's body. In accordance with one embodiment, the foam layer 16 may be formed of Ethylene vinyl acetate (EVA) foam. EVA foam is a closed cell foam that is weather and chemical resistant; has low water absorption; oil resistant; and is environmentally friendly that allows for safe disposal by recycling, dumping or incineration. EVA foam is a dense foam that readily accepts paint, glues and various finishes.

A cover layer 18 may be applied to one or more of the surfaces of the foam layer 16. The cover layer 18 may have similar characteristic as the foam layer 16 such as being weather and chemical resistant; water resistant; oil resistant; and the like. The cover layer 18 may be formed of a material such as a water resistant leather, vinyl, or the like. The listing of the above is given as an example and should not be seen in a limiting manner. In accordance with one embodiment, the cover layer 18 may be textured. By having a textured surface on the cover layer 18, one may gentle massage and/or exfoliate the area where the lotion is being applied.

On each end of the body member 12 may be a handle 14. In accordance with one embodiment, the handle 14 may be formed by forming an opening 14A in each end of the body member 12. The opening 14A may be oval in shape to allow the opening 14A to conform to the shape of the user's hands which may be slid through the openings 14A to grab the applicator 10.

A reinforcement layer 20 may be applied on a top and or bottom section of the opening 14A. In the embodiment shown in the Figures, the reinforcement layer 20 may be applied to the cover layer 18 around the opening 14A. The reinforcement layer 20 may be applied to bottom side of the foam layer 16 around the opening 14A. The reinforcement layer 20 may be used to prevent the opening 14A from tearing. The reinforcement layer 20 may be formed of similar material as the cover layer 18. In accordance with one embodiment, the reinforcement layer 20 may be formed thicker than the cover layer 18 to provide further reinforcement.

In accordance with one embodiment, a plurality of indentations 22 may be formed around the outer perimeter of each opening 14A. The indentations 22 may be used as grip members when a user's hands are inserted through each opening 14A.

Referring to FIGS. 4-10K, another embodiment of an applicator 10' is shown. The applicator 10' may be used to apply soap, lotion or the like (hereinafter lotion) to areas of a user's body which may be hard to reach. In accordance with one embodiment, the applicator 10' may be used to apply lotion to the back of a user.

The applicator 10' is similar to the applicator 10 (FIGS. 1-3) previously described. The applicator 10' may be comprised of body member 12. The body member 12 may have handle members 14 formed on each end of the body member 12. The body member 12 is formed of a material that is flexible to evenly apply the lotion to the user, but stiff enough to evenly apply the lotion.

In accordance with one embodiment, the body member 12 may be formed of a foam layer 16. The foam layer 16 may allow the body member 12 to be flexible so that the body member 12 conforms to the shape of the user. This may allow the applicator 10 to more easily reach all areas of the user's body. In accordance with one embodiment, the foam layer 16 may be formed of Ethylene vinyl acetate (EVA) foam. EVA foam is a closed cell foam that is weather and chemical resistant; has low water absorption; oil resistant; and is environmentally friendly that allows for safe disposal by recycling, dumping or incineration. EVA foam is a dense foam that readily accepts paint, glues and various finishes.

A cover layer 18 may be applied to one or more of the surfaces of the foam layer 16. The cover layer 18 may have similar characteristic as the foam layer 16 such as being weather and chemical resistant; water resistant; oil resistant; and the like. The cover layer 18 may be formed of a material such as a water resistant leather, vinyl, or the like. The listing of the above is given as an example and should not be seen in a limiting manner. In accordance with one embodiment, the cover layer 18 may be textured. By having a textured surface on the cover layer 18, one may gentle massage and/or exfoliate the area where the lotion is being applied.

In addition to the textured surface, a plurality of raised bumps 24 may be formed on the cover layer 18. The raised bumps 24 may be formed on one or both cover layers 18. The raised bumps 24 may be used as to massage the user.

On each end of the body member 12 may be a handle 14. In accordance with one embodiment, the handle 14 may be formed by forming an opening 14A in each end of the body member 12. The opening 14A may be oval in shape to allow the opening 14A to conform to the shape of the user's hands which may be slid through the openings 14A to grab the applicator 10.

A reinforcement layer 20 may be applied on a top and or bottom section of the opening 14A. In the embodiment shown in the Figures, the reinforcement layer 20 may be applied to the cover layer 18 around the opening 14A. The reinforcement layer 20 may be applied to bottom side of the foam layer 16 around the opening 14A. The reinforcement layer 20 may be used to prevent the opening 14A from tearing. The reinforcement layer 20 may be formed of similar material as the cover layer 18. In accordance with one embodiment, the reinforcement layer 20 may be formed thicker than the cover layer 18 to provide further reinforcement.

In accordance with one embodiment, a plurality of indentations 22 may be formed around the outer perimeter of each opening 14A. The indentations 22 may be used as grip members when a user's hands are inserted through each opening 14A.

The applicator 10' may have a tab member 26 formed around an outer perimeter of the applicator 10'. The tab member 26 may be formed around the entire outer perimeter, on portions of the applicator 10' where the handles 14 are not located, or the like. As shown, the tab member 26 may be formed so as to be centrally located along a thickness of the applicator 10'.

The tab member 26 may be formed in a plurality of manners. The tab member 26 may be formed along an outer edge of the foam layer 16. Alternatively, a press machine may be used to form the tab members 26 during the formation of the applicator 10'. As shown in the Figures, the tab member 26 may take on different shapes and or sizes without departing from the spirit and scope of the present invention. The tab member 26 may be formed with a tapered region 28 or the like.

The tab member 26 may be used for different purposes. As shown in the Figures, the tab member 26 may be used collect excess lotion that may be applied to a user. When moving the applicator 10' across the body of the user so that the tab member 26 is approximately parallel to the body of the user, excess lotion may be collected under the tab member 26. The user may then use the tab member 26 to evenly spread the lotion onto the user's body. The user may move the applicator 10' so that the tab member 26 is pushed downward such that a distal end of the tab member 26 touches against the body of the user. By moving the applicator 10' so that the tab member 26 touches against the body of the user across the body of the user, the lotion under the tab member 26 may be evenly applied.

The tab member 26 may be used for other purposes. For example, if the tab member 26 is fairly rigid, the tab member 26 user may move the applicator 10' so that the tab member 26 is pushed downward such that a distal end of the tab member 26 touches against the body of the user. By moving the application 10' against the body of the user, the tab member 26 may act as an exfoliator. The tab member 26 may be used for other purposes without departing from the spirit and scope of the present invention.

While embodiments of the disclosure have been described in terms of various specific embodiments, those skilled in the art will recognize that the embodiments of the disclosure can be practiced with modifications within the spirit and scope of the claims.

What is claimed is:

1. A device for applying lotion to a user's body comprising:
- a strip member comprising:
  - a foam layer;
  - a cover layer applied to a top surface of the foam layer;
  - an opening formed through each end of the strip member through the foam layer and the cover layer forming a handle area on each end of the strip member;
  - a reinforcement layer applied to a top surface of the cover layer around each opening and to a bottom surface of the foam layer around each opening; and
  - a tab member formed along an entire outer perimeter of non-handle areas of the strip member, the tab member being flexible to allow a distal end of the tab member to touch a body of the user to evenly spread lotion collected under the tab member.

2. A device for applying lotion to a user's body in accordance with claim 1, wherein the foam layer is an Ethylene vinyl acetate (EVA) foam layer.

3. A device for applying lotion to a user's body in accordance with claim 1, wherein the tab member is centrally located along a thickness width of the strip member.

4. A device for applying lotion to a user's body in accordance with claim 1, comprising a plurality of raised bumps formed on the cover layer.

5. A device for applying lotion to a user's body comprising:
a strip member comprising:
a foam layer; and
a cover layer applied to a top surface of the foam layer;
an opening formed through each end of the strip member through the foam layer and the cover layer forming a handle area on each end of the strip member;
a reinforcement layer applied around each opening; and
a tab member formed along an entire outer perimeter of non-handle areas of the strip member, the tab member centrally located along a thickness width of the strip member, the tab member being flexible to allow a distal end of the tab member to touch a body of the user to evenly spread lotion collected under the tab member.

6. A device for applying lotion to a user's body in accordance with claim 5, wherein the reinforcement layer is applied to a top surface of the cover layer around each opening.

7. A device for applying lotion to a user's body in accordance with claim 5, wherein the reinforcement layer is applied to a bottom surface of the foam layer around each opening.

8. A device for applying lotion to a user's body in accordance with claim 5, wherein the reinforcement layer is applied to a top surface of the cover layer around each opening and to a bottom surface of the foam layer around each opening.

9. A device for applying lotion to a user's body in accordance with claim 5, wherein the foam layer is an Ethylene vinyl acetate (EVA) foam layer.

10. A device for applying lotion to a user's body in accordance with claim 5, wherein the cover layer is textured.

11. A device for applying lotion to a user's body in accordance with claim 5, comprising a plurality of raised bumps formed on the cover layer.

12. A device for applying lotion to a user's body comprising:
a foam layer;
a cover layer applied to a top surface of the foam layer;
a pair of openings formed through the foam layer and the cover layer forming a pair of handles, one handle located on each end of the device;
a reinforcement layer applied around each opening;
a tab member formed along an entire outer perimeter of non-handle areas of the strip member, the tab member being centrally located along a thickness width of the strip member, the tab member being flexible to allow a distal end of the tab member to touch a body of the user to evenly spread lotion collected under the tab member; and
a plurality of raised bumps formed on the cover layer.

13. A device for applying lotion to a user's body in accordance with claim 12, wherein the reinforcement layer is applied to a top surface of the cover layer around each opening.

14. A device for applying lotion to a user's body in accordance with claim 12, wherein the reinforcement layer is applied to a bottom surface of the foam layer around each opening.

15. A device for applying lotion to a user's body in accordance with claim 12, wherein the reinforcement layer is applied to a top surface of the cover layer around each opening and to a bottom surface of the foam layer around each opening.

16. A device for applying lotion to a user's body in accordance with claim 12, wherein the foam layer is an Ethylene vinyl acetate (EVA) foam layer.

17. A device for applying lotion to a user's body in accordance with claim 12, wherein the cover layer is textured.

18. A device for applying lotion to a user's body in accordance with claim 12, wherein the cover layer is leather.

* * * * *